US007112146B2

(12) United States Patent
Bennett

(10) Patent No.: US 7,112,146 B2
(45) Date of Patent: Sep. 26, 2006

(54) PUTTING PRACTICE AND TRAINING DEVICE

(76) Inventor: Russ Bennett, 5160 Eleventh Concession RR #3, Maidstone, Ontario (CA) N0R 1K0

( * ) Notice: Subject to any disclaimer, the term of this patent is extended or adjusted under 35 U.S.C. 154(b) by 0 days.

(21) Appl. No.: 11/143,615

(22) Filed: Jun. 3, 2005

(65) Prior Publication Data

US 2005/0277482 A1 Dec. 15, 2005

(51) Int. Cl.
*A63B 69/36* (2006.01)

(52) U.S. Cl. ..... 473/257; 473/261

(58) Field of Classification Search ..... 473/195, 473/210, 229, 261, 268, 257, 265, 266, 269; 248/353, 156, 370
See application file for complete search history.

(56) References Cited

U.S. PATENT DOCUMENTS

| | | | | |
|---|---|---|---|---|
| 3,656,752 | A * | 4/1972 | Moriarty | 473/261 |
| 4,762,325 | A * | 8/1988 | McCleery | 473/210 |
| 6,458,041 | B1 * | 10/2002 | Brandt | 473/268 |
| 6,755,751 | B1 * | 6/2004 | Chapman | 473/229 |
| 6,773,357 | B1 * | 8/2004 | Tai et al. | 473/195 |

* cited by examiner

*Primary Examiner*—Nini F. Legesse
(74) *Attorney, Agent, or Firm*—Miller Thomson LLP

(57) ABSTRACT

A putting practice and training device having a support member having a first end and a second end. The first end may be adapted engage a surface. A rotatable, swingable arm may have at least two members arranged where only one member is visible when viewing the arm from above the putting practice and training device. At least one indicating means may be slidably mounted on at least one member. The rotatable, swingable arm may be adapted to perpindicularily engage the second end of the support member whereby the arm rotates the two members to be level with the surface.

19 Claims, 9 Drawing Sheets

PUTTING PRACTICE AND TRAINING DEVICE

FIELD OF THE INVENTION

This invention relates in general to practice or training devices for golf and more particularly to a practice and training device for putting in golf that addresses eye over the ball, having the putter centered to the ball and the length of stroke.

BACKGROUND OF THE INVENTION

In order to improve one's ability on the golf course, there are a number of areas that a player can focus on. For instance correct stance when addressing the ball, proper head and body movement, proper swing, or length of stroke. Different challenges are presented depending on a player's strengths, weaknesses, abilities and physical limits. Although many golfers spend a great deal of time practicing tee-off shots and fairway shots, a great deal of time is actually spent on the green and putting. Despite the amount of time devoted to shots on the green, players often do not spend a great deal of time practicing to improve their putting game despite the fact that their putting ability is key to a successful round of golf.

In general to improve one's putting game, the player must first be able to visualize an imaginary line from the golf ball to the cup and take into account various factors such as slope of the green, wind, conditions of the course etc. The golfer must next be able to position him/herself correctly in relation to the ball, namely the body should be aligned parallel to the putting line. Specifically, the player should position their head directly over the ball with the eyes looking down vertically over the ball during the entire putting stroke. Finally the face of the putter should be oriented at a right angle to the imaginary line, and the putter shaft should move parallel to the imaginary line. One must also ensure that the stroke length/weight is adjusted to accommodate the speed of the green. All of these skills must be put together for the golfer to have a successful putt. There have been a number of devices developed to try and help golfers improve these various skills and thereby improve their putting game.

Prior art practice devices for putting have been devised to address some of the afore noted problems. For example, U.S. Pat. No. 6,458,041 issued on Oct. 1, 2002 to Brandt relates to a golf ball putting device used by a golfer to practice a line of sight directly over the top center of a golf ball when putting the ball. By practicing with the device, the golfer enhances his or her skill in alignment of sight over the top of the golf ball with improved putting skills. The golf ball putting device includes an upright support having a vertical lower portion, a curved middle portion and a horizontal upper portion. The lower portion can be inserted into a ground surface or inserted into a stand. The upper portion includes a forked end. The forked end includes a first fork arm and a second fork arm with an eye alignment opening there between. Ends of the first fork arm and the second fork arm are joined together by an elongated upper sight alignment member. The upper sight alignment member, when properly positioned, is parallel to the direction of travel of the golf ball when it is putted. Suspended from opposite ends of the upper sight alignment member are a pair of suspension chains. Lower ends of the chains are attached to opposite ends of an elongated lower sight alignment member. When the upper and lower sight alignment members are placed above the top of the golf ball and the golfer's line of sight aligns the upper sight alignment member above the lower sight alignment member, then the golfer knows his or her line of sight is directly above the golf ball.

The invention disclosed in U.S. Pat. No. 6,458,041, however, requires the player to constantly adjust the device by pulling the device out of green and repositioning it to the desired position. Furthermore, this device does not allow the player to make comparisons between shots to develop consistency of attempted shots so as to provide a reference point and therefore help the player with length of stroke.

U.S. Pat. No. 5,303,926 which issued on Apr. 19, 1994 to Owens et al relates to a portable golf swing practice device. The practice device includes a weighted base and an upstanding flute guide post with a positioning bar adjustably mounted between ear portions of a post encircling locking jaw which is vertically and rotatably adjustable on the guide post. By setting the positioning bar in any one of a plurality of positions relative to the user, each of the proper body positions and swing motions can be reinforced thus improving the user's stance and wring during actual playing. All components of the device are made of a rigid high strength polyvinglchloride to prevent corrosion.

Carpenter is the owner of U.S. Pat. No. 4,032,157 which issued on Jun. 28, 1977 to Carpenter relates to a base having a lower, ground-engageable portion and an upper portion. An indicator mechanism is formed by first and second perpendicularly intersecting planar members. Each of the outer planar surfaces of the planar members includes a distinctive color, and each color is different from the others. The first planar member defines a plane oblique to the ground while the second planar member defines a plane normal to the ground. The indicator mechanism is attached to the upper portion of the base. When the golfer assumes a golfing stance adjacent the base and gazes at the indicator mechanism, the upper edges of the planar members form an inverted T-shape, the side surfaces of the planar members not being visible.

U.S. Pat. No. 5,720,669 which issued on Feb. 24, 1998 to Pearson relates to the golf club practice device of the present invention which includes a supporting member, an elongated member and a connecting member which form means for perfecting a golfer's swing. The supporting member supports the device on a generally planar base from which a positioned golf ball may be driven such as a golf swing practice area or a plate covered with a mat of a synthetic material. The connecting member makes right angle elbow connections with one end of the elongated member and with the end of the supporting member distal the planar base. The elongated and connecting members are substantially parallel to the planar base. A golf ball may be positioned on the planar base under the connecting member between the elbow connections of the elongated and supporting members so that the golf ball would just be completely visible to the user. A golfer takes a proper stance with respect to the ball so that the elongated member is substantially parallel to the golfer's body when facing the practice device and uses the elongated member which is parallel to the surface of the practice area as a guide to a perfect swing. If the downstroke of the golf swing is not in the an optimum golf path, one of the members of the device is struck with the head or shaft of the golf club. With frequent practice, a golfer using the golf club practice device can learn to avoid hooks, slices, topping the ball and other swing imperfections.

U.S. Pat. No. 5,899,816 which issued on May 4, 1999 to Pearson relates to a golf club practice device consisting of: a generally planar base from which a positioned golf ball may be driven; a supporting member in a first plane extending vertically from the surface of the generally planar base at a distance of eleven to fourteen inches, and having a first end and a second end connected to the planar base; an elongated member in a second plane substantially parallel to the generally planar base, having a length of 30 inches to four feet, and having a first end and a second end distal said supporting member; and a connecting member in the same plane as the elongated member, between the first end of the supporting member and the first end of the elongated member, substantially parallel to the generally planar base, having an elbow connection to each of the first ends, substantially perpendicular to the supporting member and the elongated member, and having a length of four to eight inches; wherein the supporting member, the elongated member and the connecting member form a single one piece construction; and wherein the connecting member is over a golf club head when the club head is addressing a golf ball on the surface of the generally planar base directly under a location on the connecting member as a user starts a practice golf swing that is a critical distance from the elbow connection of the connecting member to the first end of the supporting member and between the first ends of the elongated member and the supporting member so that the golf ball would just be completely visible to the user and wherein the elongated member is substantially parallel to the user's body as the user faces the practice device and serves as a guide for the user to achieve an optimum golf swing in which the golf club is brought back in the direction of the second end of the elongated member and an optimum golf swing is achieved when no part of the device is struck during a complete golf swing.

Prior art devices may focus on head over the ball, but fail to address the length of stoke. Thus a putting practice and training device which helps the player improve his address to the ball namely eye over the ball, having the putter centered to ball, and length of stroke is desirable.

SUMMARY OF THE INVENTION

An object of one aspect of the present invention is to provide an improved putting practice and training device.

In accordance with one aspect of the present invention there is provided a putting practice and training device having a support member having a first end and a second end. The first end may be adapted engage a surface. At least one rotatable, swingable arm may have at least two members arranged where only one member is visible when viewing the arm from above the putting practice and training device. At least one indicating means may be slidably mounted on at least one member. The rotatable, swingable arm may be adapted to engage the second end of the support member whereby the arm positions the two members to be level with the surface.

Conveniently, the first end of the support member may be a base for use of the device indoors, or outdoors. In a second embodiment of the present invention the first end of the support member may be a stake to engage the green and therefore is portable out on the golf course and can be easily inserted into the ground without disrupting the green's surface.

Preferably, the putting practice and training device may be a 'wire over wire' design with adjustable beads to allow for determination of the length of stroke and comparison to subsequent strokes Advantages of the present invention are: incorporates all given principles of good putting—position to the ball; alignment to the hole; length of stoke; allows for minor adjustments of alignment or stroke length, and after successful holing of the ball, the device reinforces repeatability and consistency; the wire over wire design allows the golfer to see the putter tracking along the line of the putt and ensures square contact; can be used on any surface and is easily portable from home, office, or the golf course. Furthermore, the length of the wires of the instant invention helps the golfer to align their body along the path of the putt, where prior devices are too short or narrow to allow proper body positioning. The round wire also allows the golfer to easily move the device left or right without removing from the stand or ground. The golfer can easily follow the line of the putter under the wires to ensure a straight/square stroke to the ball. The beads can be positioned for different lengths depending on the speed of the putting surface.

BRIEF DESCRIPTION OF THE DRAWINGS

A detailed description of the preferred embodiments are provided herein below by way of example only and with reference to the following drawings, in which.

Figure 1:
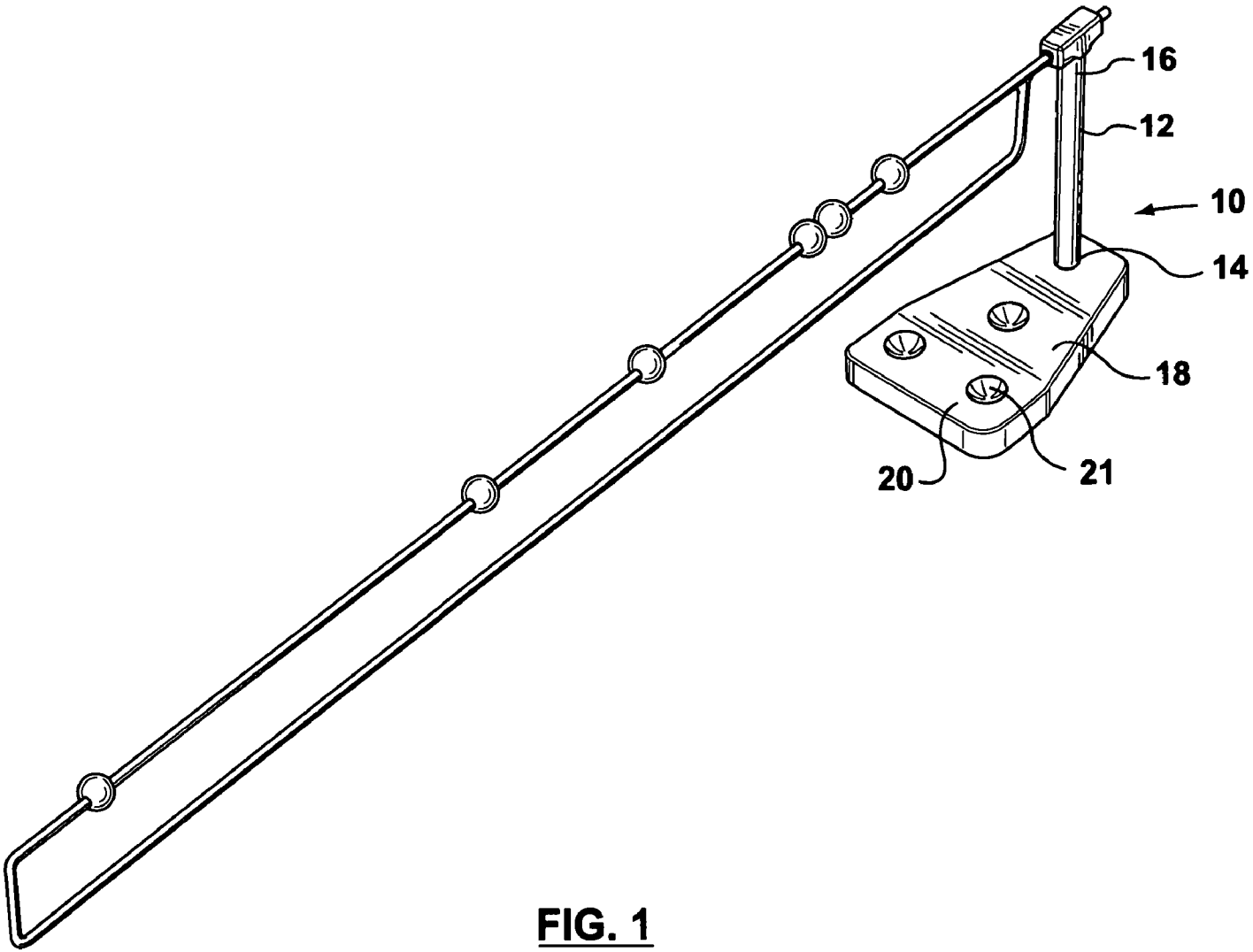
FIG. 1 in a perspective view, illustrates a putting practice and training device in accordance with a preferred embodiment of the present invention.
Figure 2:
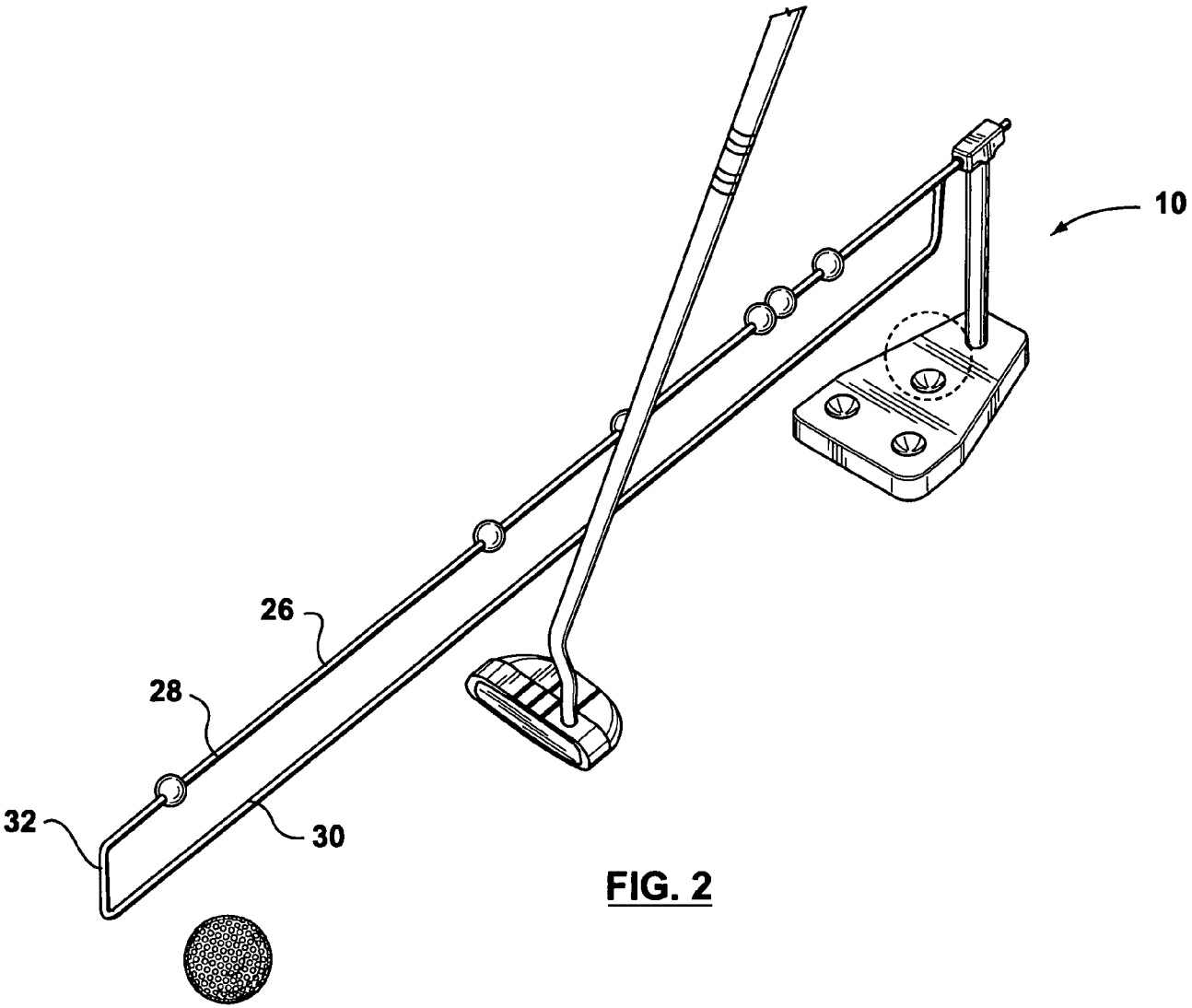
FIG. 2 in a perspective view, illustrates the putting and training device of FIG. 1 in use.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIG. 1, there is illustrated in a perspective view, a putting practice and training device 10 in accordance with a preferred embodiment of the present invention. The putting practice and training device 10 includes a support member 12 having a first end 14 and a second end 16. The first end 14 may be adapted engage a surface 18. The surface 18 may be defined as a base 20 or the surface 18 may be the golf green 22. Specifically, the first end 14 may be inserted into a base 20 so that the device 10 may be used indoors. The base 20 can have a variety of configurations as long as it can receive the first end 14 of the support member 12, and can include dimples 21 that can be used to hold golf balls.

Figure 6:
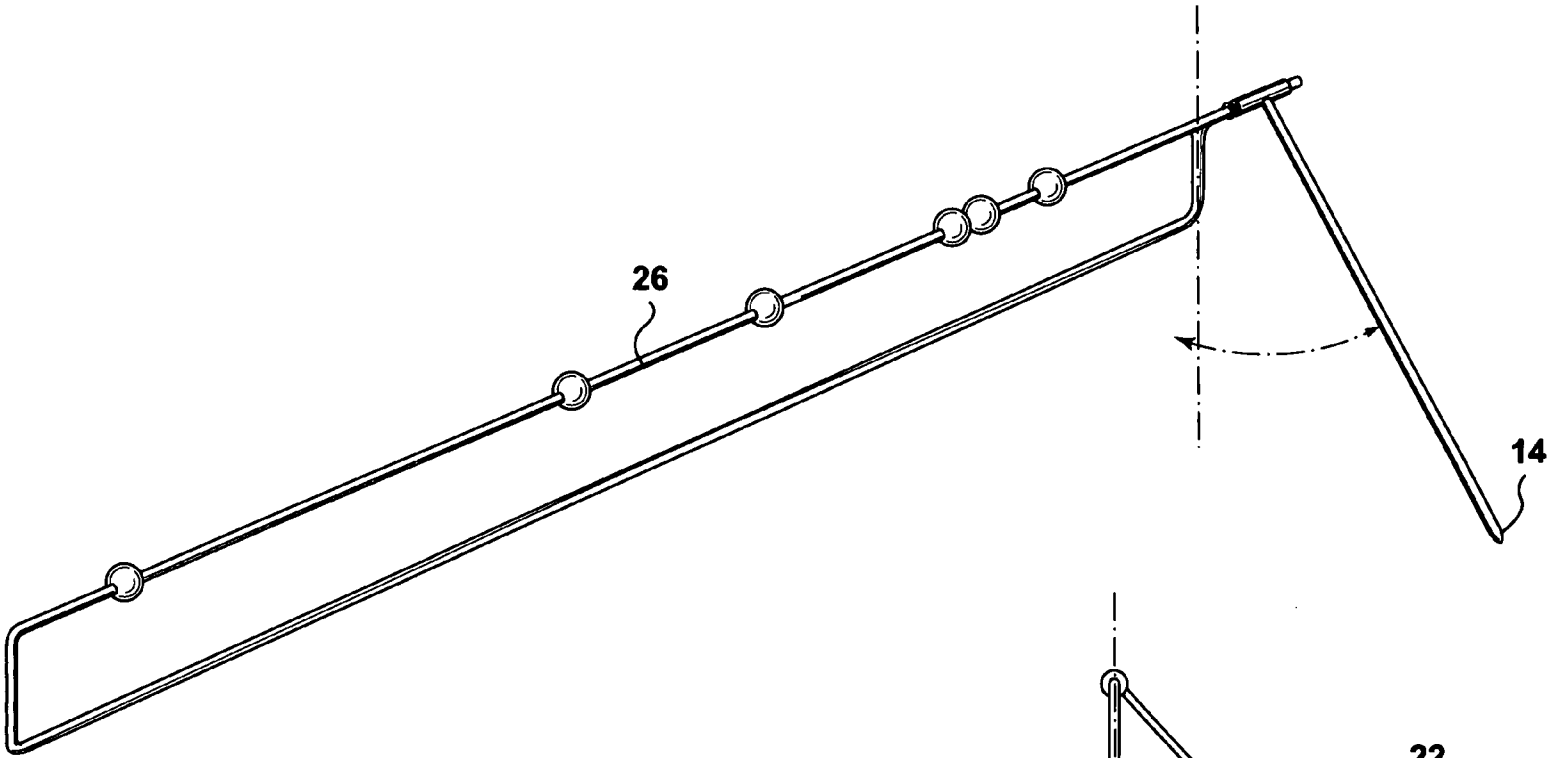
FIG. 6 in a perspective view, illustrates the putting and training device in accordance with a second preferred embodiment of the present invention.
Figure 6A:
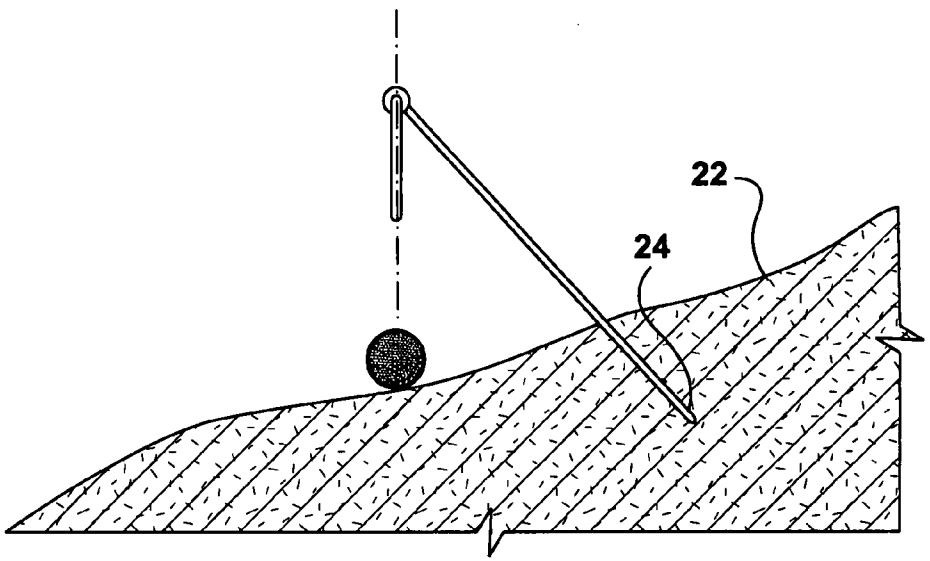
FIG. 6A in a perspective view, illustrates the putting and training device of FIG. 6 whereby said device rotates to level.
Figure 7A:
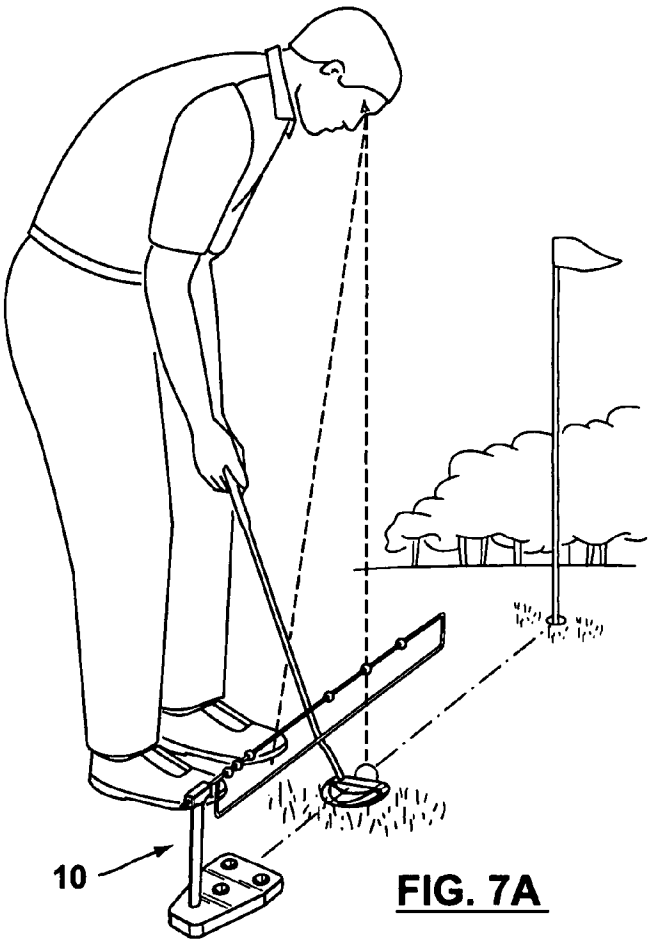
FIG. 7*a* in a perspective view, illustrates the user using the present invention to help with eye and foot alignment.
Figure 7:
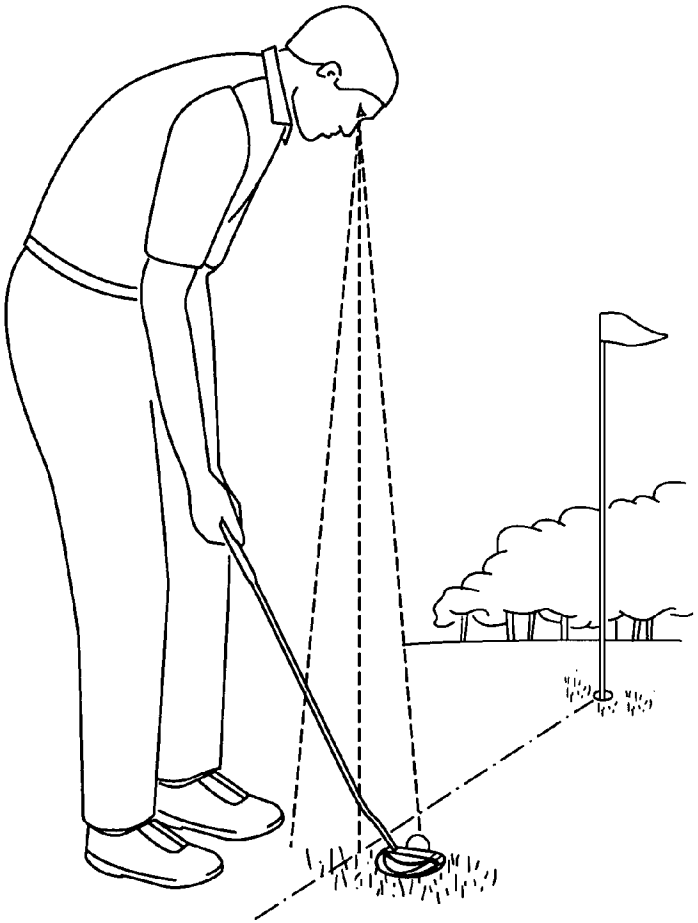
FIG. 7 in a perspective view, illustrates the user aligning feet and eyes.

However, the first end 14 may be a stake 24 or spike as illustrated in FIGS. 6 and 6A. This embodiment allows for the device 10 to be portable on to the golf green and be inserted into the green with very little damage. Furthermore, the stake 24 can be inserted into any terrain such as a slope or hill, as illustrated in FIG. 6A and still allow the player to utilize the device 10 and practice. The round geometry of the support member 12 allows easy adjustment to the putting line without removing it from the base 20 or golf green 22.

Figure 3:
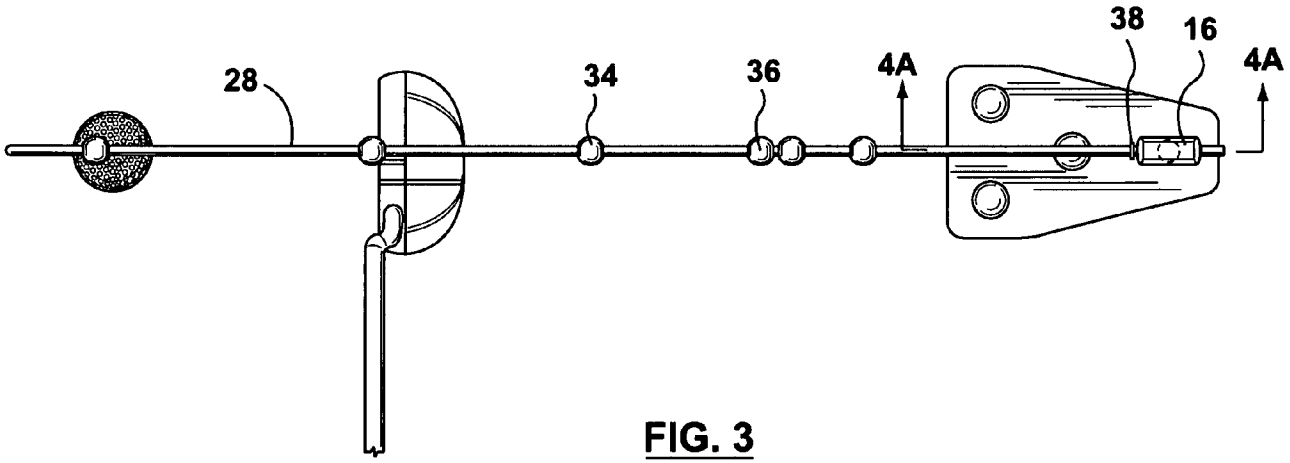
FIG. 3 in a top view, illustrates the putting and training device of FIG. 2.
Figure 3A:
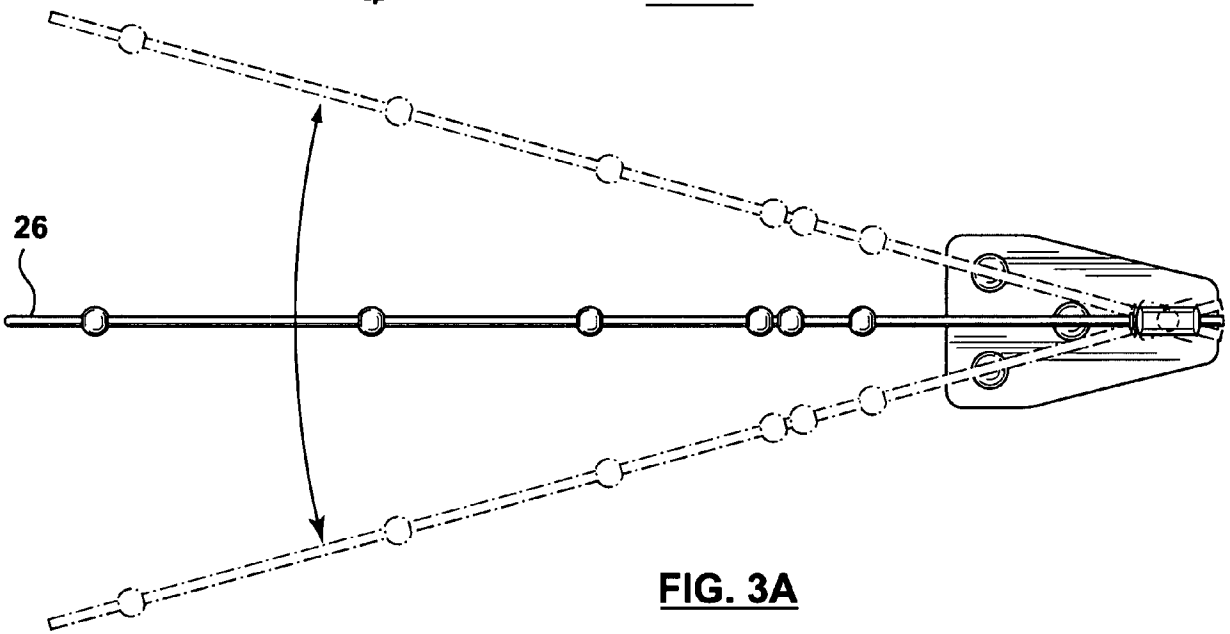
FIG. 3A in a top view, illustrates the putting and training device of FIG. 2 swinging or changing direction depending on the direction of the hole.

At least one rotatable, swingable arm 26 has at least two members 28 and 30. The arm 26 may be arranged in a variety of ways, however what ever the configuration, only one member 28 or 30 should visible when viewing the arm 26 from above the putting practice and training device 10. For example, as viewed in FIGS. 1–3A, the putting practice and training device 10 may be a wire over wire design wherein each wire or member 28 and 30 is arranged one on top of the other and spaced apart forming a type of loop 32. As illustrated in FIGS. 3 and 3A only one member or wire 28 or 30 can be viewed from above. In this arrangement the lower wire 30 may be a different colour so that it is distinguishable from the top wire 28.

Figure 8C:
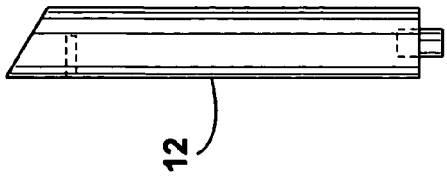
FIGS. 8*a–c* in a perspective view, illustrates a second preferred embodiment of the present invention with the arms suspended over one another.
Figure 8A:
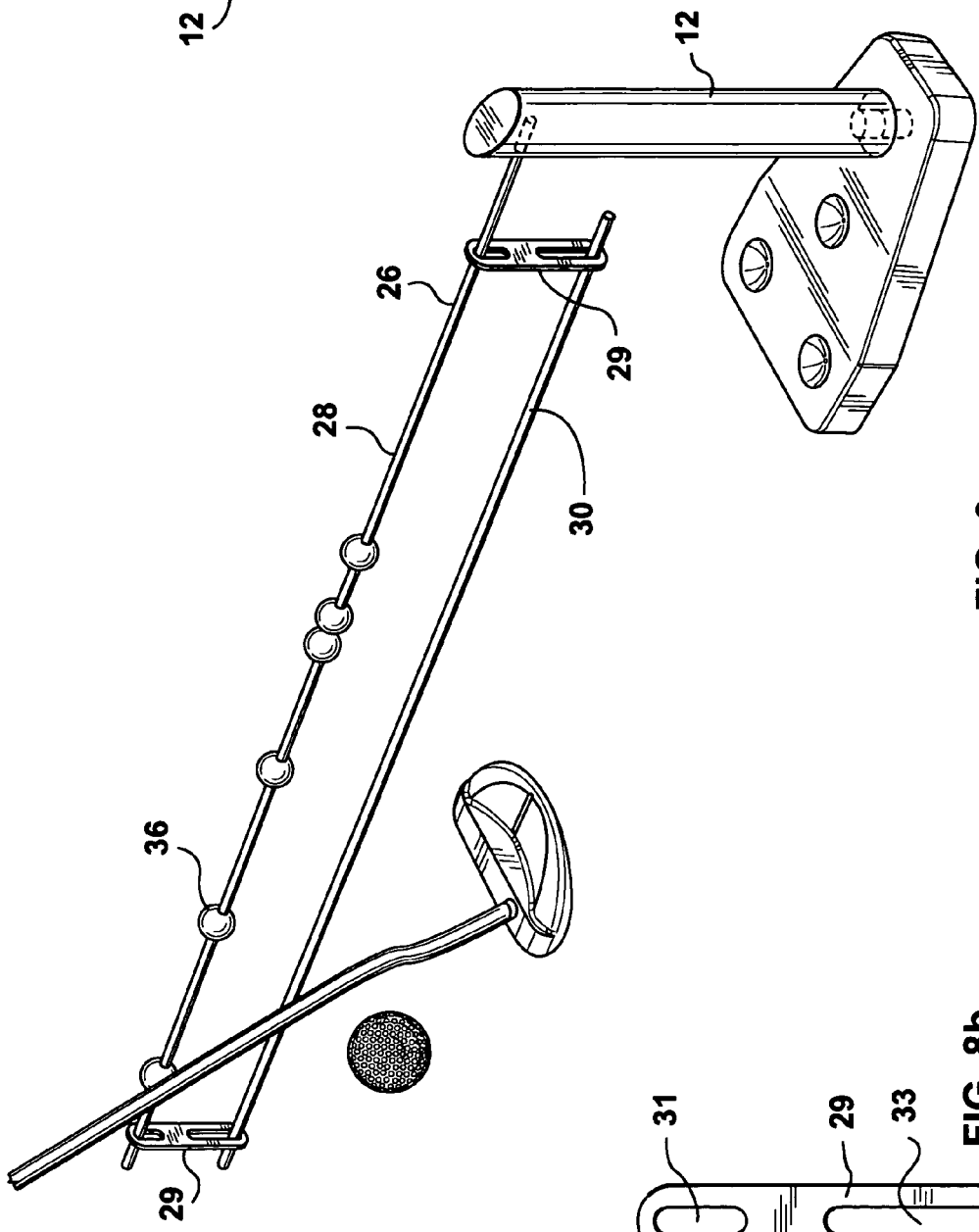
Figure 8B:
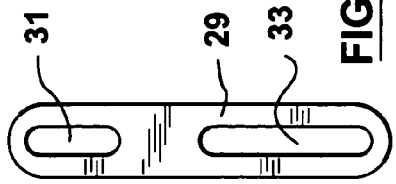
Figure 9:
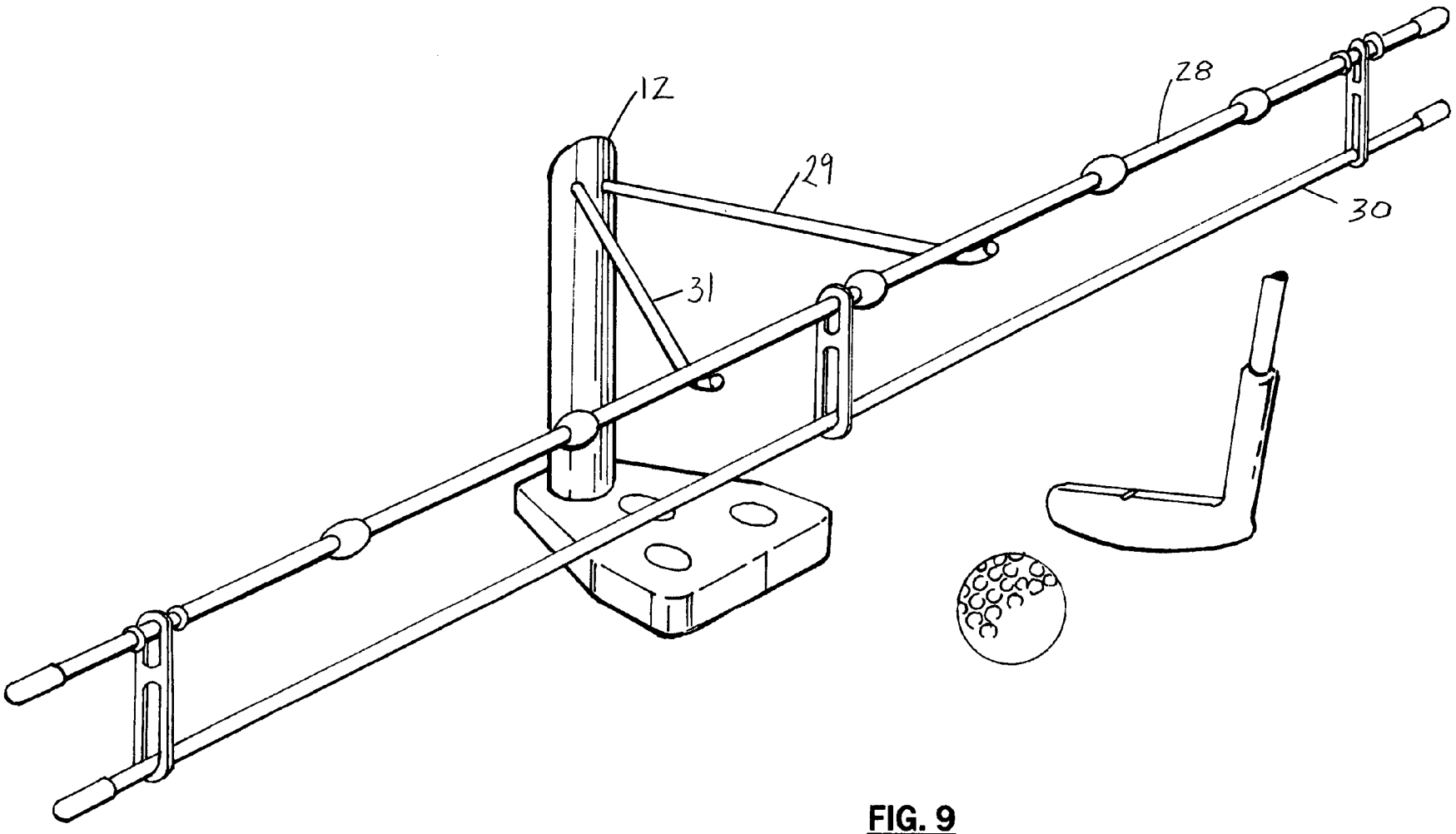
FIG. 9 in a perspective view, illustrates a third preferred embodiment of the present showing the arms mounted to the support member from the side.

Referring to FIGS. 8*a*–*c* the arm 26 may also be two separate members 28 and 30 that are suspended one over the other by using a suspending means 29 such as a clip. The suspending means 29 is configured to have the ability to hold the two separate members 28 and 30 one over the other without touching each other. Furthermore the suspending means 29 allows the two separate members 28 and 30 to be cradled in two apertures 31 and 33. With this configuration, only one member 28 or 30 is visible when viewing the arm 26 from above the putting practice and training device 10. FIG. 9 illustrates the two members 28 and 30 being positioned by two arms 29 and 31. The arms 29 and 31 extend from the support member 12 and engage one member 28 near the mid point of the member 28 thereby allowing side mounting of the members 28 and 30. The arms 29 and 31 may be slightly bent up where the engage the member 28 to allow for the balancing of the member 28. This positioning allows the member 28 to swing to a level position. Furthermore the side mounted embodiment allows for members 28 to have greater lengths thereby allowing for practicing different stroke lengths.

The members 28 and 30 and preferably the top member or wire 28 may have at least one indicating means 34. The indicating means 34 may be slidably mounted on at least one member 28 or 30. The indicating means 34 may be further defined as bead 36 or beads that can slide back and forth along the wire or member 28. The beads 36 can therefore be positioned to mark for the player the length of the stroke the player can or should take for different shots. By having this marking or indicating ability, the player has reference points for making comparisons between shots and the effectiveness the length of stroke has on each shot. This is critical for repeatability of a shot so that the player can practice the same shot and develop an understanding that a particular length of stroke provides a certain shot or result.

Figure 4:
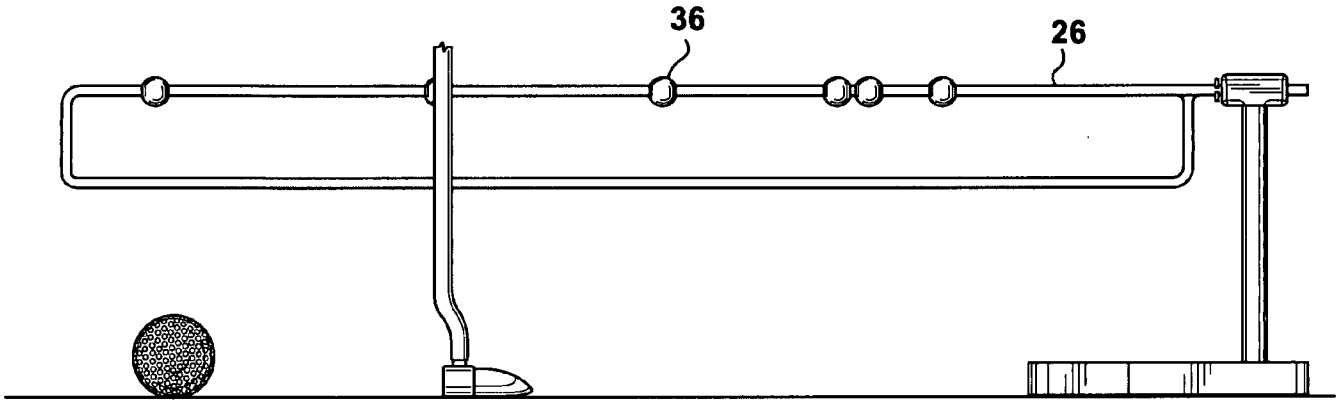
FIG. 4 in a front plan elevation view, illustrates the putting and training device of FIG. 1 in use.
Figure 4A:
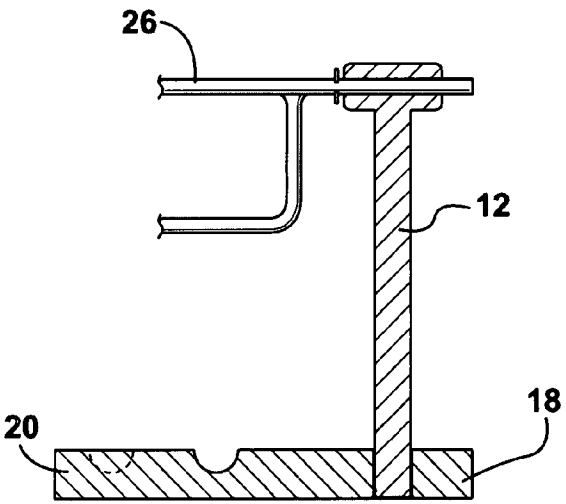
FIG. 4A in a cross-sectional view along the lines 4A, illustrates the putting and training device of FIG. 3.
Figure 5:
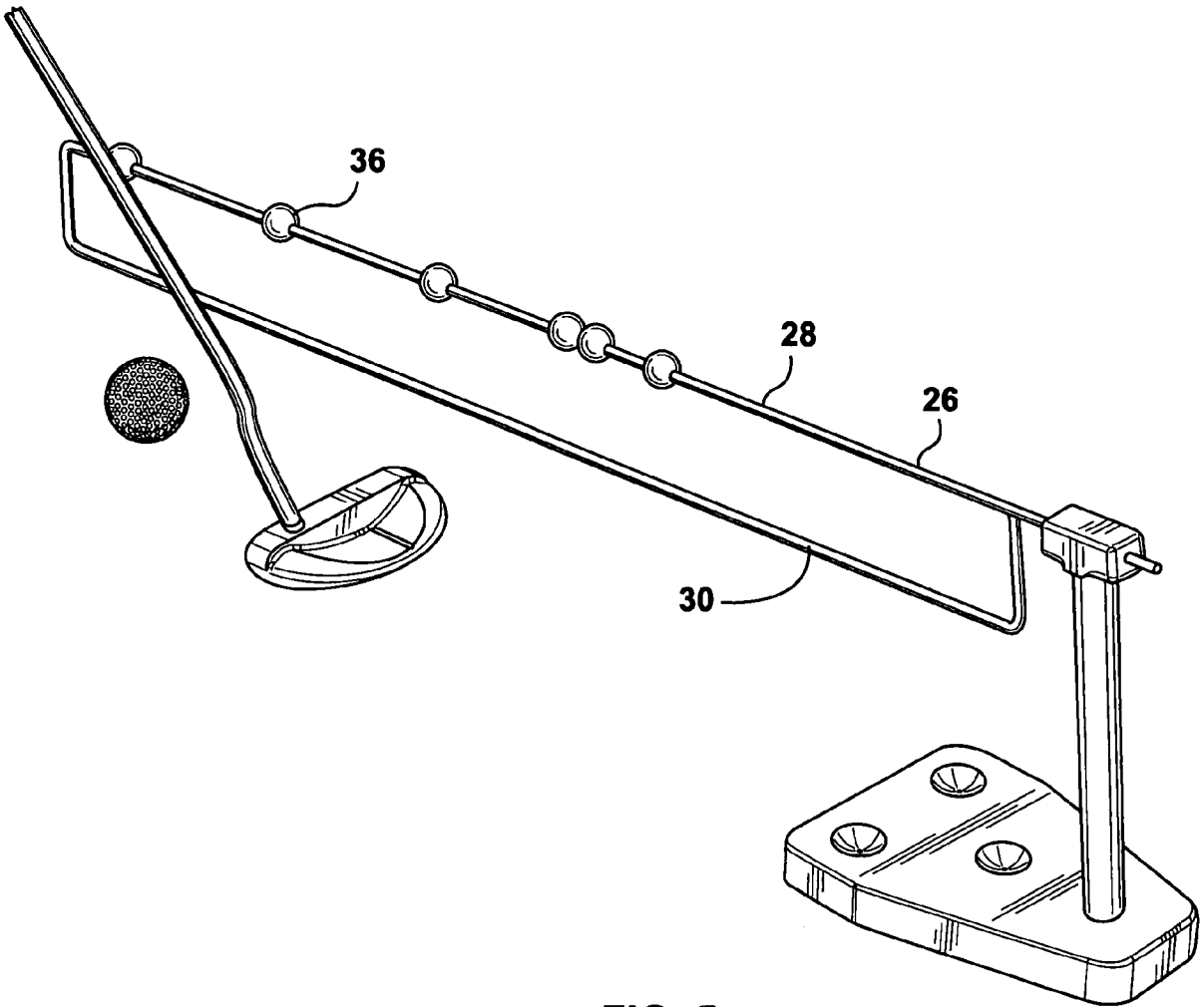
FIG. 5 in a perspective view, illustrates the putting and training device of FIG. 1 in use.

The rotatable, swingable arm 26 may be adapted at one end 38 to perpindicularily engage the second end 16 of the support member 12. More specifically, referring to FIGS. 3A, 6 and 6A, the engagement of the support member 12 and the arm 26, allows for the arm 26 to rotate thereby keeping the two members 28 and 30 level with the surface 18. Specifically, the combination of the arm 26 and its engagement with the support member 12 allows the arm 26 to swing and rotate. As illustrated in FIG. 4A the support member 12, when inserted into the surface 18, whether the base 20 or the golf green 22, is configured so as to rotate within the surface 18 no matter what type of surface 18. This ability allows the device 10 to be swung into various positions and up to 360°. Therefore, the player can move the arm 26 to set up the device 10 into a different position for practice shots without having to reposition the entire device 10 as in FIG. 3A.

Furthermore, the arm 26 itself can rotate freely within the second end of the support member 12. Referring to FIGS. 4A, 6 and 6A, the arm 26 can be inserted into an opening (not shown) on the support member 12. The support member 12 may have multiple openings which allow for the arm 26 to be adjusted from a height perspective. The arm 26 may be mounted as low as 3 inches from the ground. The arm 26 is always perpendicular to the support member 12 so that regardless of the surface 18, the arm 26 can rotate to level. This ability to rotate is also aided by the design of the device 10 in that there is sufficient weight in the device 10 to help the device 10 rotate to level. The rotation to the level position allows the player to utilize the device 10 on various sloping surfaces as the device 10 will always rotate to level. This level position allows the player to view a single member 28 from above and use the device 10 as explained below. More specifically, when the device 10 is level, the lower wire 30 that is in a different colour (such as red) from the top wire 28, cannot be seen by the player. If the player can see any red, i.e. the wire 30, then the player has to readjust his/her stance.

The device 10 may be manufactured in different materials to suit a variety of prices and conditions. One model may be left at the office which will enhance the decor of the office, for example oak or mahogany stand with brass rails and beads. Another model may be molded out of strong, lightweight plastic. Another design may be steel rails powder coated to prevent rusting. The variety is intended to suit different prices and environments, while still retaining the integrity of the practice device 10.

In operation, the putting practice and training device 10 of the first embodiment requires the arm 26 to be inserted into the support member 12 that has been inserted into the base 20. The arm 26 is swung to line up with a hole or cup (not shown) that will catch the golf ball. Referring to FIGS. 2, 3, 4, 5, 7 and 7*a*, the player can position and center the golf ball under the arm 26. The player can then position a bead 36 at a distance on the member 28 that will indicate how far back the player must bring the putter prior to striking the golf ball. The player can approximate the length of their stroke when positioning or moving the bead 36 to that spot on the wire or member 28. The player may then assume the appropriate stance and line the putter up with the bead 36. He/she is now ready to putt and is able to follow the path of the putter along the wire 28 to the location of the bead 36, and then follow through to striking the golf ball. All putters are etched with a line on top of the putter to assist in alignment.

As illustrated in FIG. 3, when the player properly assumes the correct position and views the device 10 from above, only the top wire or member 28 can be seen. Should the player not have correct head alignment in relation to the golf ball, the bottom wire or member 30 may be seen thereby immediately indicating to the player that his/her stance or position must be corrected. This indication may be more readily apparent to the player if the bottom wire or member 30 is in a different colour such as red to the top wire or member 28. The player may then bring the putter back to the appropriate distance indicated by the indicating means 34 or bead 36 and then bring the putter head forward to strike the golf ball.

Depending on the results (if not holed) the player can easily adjust the direction/alignment of the arm 26 (left or right) and the position of the bead 36 depending if the putt was too long or short. The player then repeats their set up and attempts the putt again. Depending upon success the player can repeat the process until the ball is holed and then continue holing balls to ensure consistency and confidence. The device 10 therefore reinforces a repeatable stroke and stance to improve muscle memory. Furthermore the device 10 allows for immediate visual feedback not only during the stroke but also at impact.

After repeated success, the device 10 can be moved to a different distance and using the second bead 36, move it along the wire 28 to adjust for the difference in length. The process can be repeated for the third, fourth, and fifth beads 36. This allows the golfer to determine the length of stoke for different distances and green speeds.

During this process the player must ensure that their eyes and stance are such that they only see the top wire or member 28. Therefore, the device 10 not only helps with eye over the ball alignment but also that the body is aligned parallel to the putting line, the stroke length/weight is adjusted to the speed of the green, and the putting stroke is straight to ensure the head of the putter is square to the golf ball at impact. Furthermore, as the device 10 always rotates to level, the player may use the device 10 on various terrains.

Other variations and modifications of the invention are possible. All such modifications or variations are believed to be within the sphere and scope of the invention as defined by the claims appended hereto.

I claim:

1. A putting practice and training device that engages the ground comprising:

(b) a support member having a first end and a second end, the first end adapted to engage the ground;

(c) at least one rotatable, swingable arm, the arm having at least two members arranged wherein only one member is visible when viewing the arm from above the putting practice and training device; and (d) at least one indicating means slidably mounted on at least one member;

wherein the rotatable, swingable arm is adapted to engage the second end of the support member whereby the arm positions the two members to be level with the surface.

2. A putting practice and training device as claimed in claim 1 wherein the rotatable, swingable arm has a first end and a second end and the second end of the arm perpendicularly engages the second end of the support member whereby the arm can swing and rotate.

3. A putting practice and training device as claimed in claim 1 wherein the rotatable swingable arm is two arms that each engage one member towards a mid point of the member.

4. A putting practice and training device as claimed in claim 1 wherein the two members are a first wire over a second wire loop.

5. A putting practice and training device as claimed in claim 1 wherein the two members are two wires suspended by a suspending means one above the other.

6. A putting practice and training device as claimed in claim 5 wherein the suspending means is a clip having two apertures adapted to receive the two wires.

7. A putting practice and training device as claimed in claims 4 or 5 wherein the one wire is a different color from the second wire.

8. A putting practice and training device as claimed in claims 4 or 5 wherein the indicating means is at least one bead that can slide along the first wire.

9. A putting practice and training device as claimed in claims 4 or 5 wherein the indicating means is a series of different colored beads.

10. A putting practice and training device as claimed in claim 1 wherein the first end further comprises a base that receives the first end of the support member and engages the ground.

11. A putting practice and training device as claimed in claim 10 wherein the base further comprises a series of dimples that can hold golf balls.

12. A putting practice and training device as claimed in claim 1 wherein the first end of the support member is a stake that engages the ground.

13. A putting practice and training device as claimed in claim 1 wherein the device is made from wood, brass, plastic, metal, or powder covered steel.

14. A method of putting using a putting practice and training device for a player comprising;

(a) inserting into a surface a support member having a first end and a second end, the first end adapted to engage the surface;

(b) inserting into the second end of the support member a rotatable, swingable arm, the arm having at least two members arranged wherein only one member is visible when viewing the arm from above the putting practice and training device, wherein the rotatable, swingable arm is adapted to perpindicularily engage the second end of the support member whereby the arm rotates the two members to be level with the surface;

(c) aligning the device to a target and positioning a golf ball under the arm;

(d) positioning at least one indicating means slidably mounted on at least one member to indicate how far back the player should position a putter; and (e) positioning the player for putting so that only one member is visible from above the device by the player.

15. A method of putting using a putting practice and training device for a player as claimed in claim 14 wherein the arm may swing to adjust the direction and alignment of the arm.

16. A method of putting using a putting practice and training device for a player as claimed in claim 15 wherein the arm rotates a total of 360°.

17. A method of putting using a putting practice and training device for a player as claimed in claim 15 wherein more than one indicating means is adjustable and can be slid along the arm to various distances.

18. A method of putting using a putting practice and training device for a player as claimed in claim 15 wherein the arm rotates to level when the device is placed on a flat surface.

19. A method of putting using a putting practice and training device for a player as claimed in claim 15 wherein the arm rotates to level when the device is place on a sloping surface.

* * * * *